US005267871A

United States Patent [19]

Flanagan

[11] Patent Number: 5,267,871

[45] Date of Patent: Dec. 7, 1993

[54] SWITCHING ELECTRICAL CONNECTOR

[75] Inventor: James R. Flanagan, Harrisburg, Pa.

[73] Assignee: The Whitaker Corporation, Wilmington, Del.

[21] Appl. No.: 908,697

[22] Filed: Jul. 2, 1992

[51] Int. Cl.[5] ..... H01R 13/66; H01R 13/70

[52] U.S. Cl. ..... 439/188; 439/186; 200/51.1

[58] Field of Search ..... 439/186, 188, 507, 510–515, 439/581; 200/51.09, 51.1

[56] References Cited

U.S. PATENT DOCUMENTS 2,312,002 2/1943 Schmitt ..... 439/188
3,949,180 4/1976 Ojima et al. ..... 200/51.1
4,633,048 12/1986 Komatsu ..... 439/188
5,030,123 7/1991 Silver ..... 200/51.1
5,108,300 4/1992 Weber ..... 439/188
5,112,236 5/1992 Martin et al. ..... 439/186

*Primary Examiner*—Paula A. Bradley

[57] ABSTRACT

An electrical connector (1) having an internal switch (2), comprises, a conductive exterior shell (3) with a stepped interior (30), an insulator (4) encircled by the shell (3), and a pair of electrical contacts (5, 6) retained within the insulator (4), a plug contact receiving passage (16) encircled by the insulator (4), and the contacts (5, 6) retaining the insulator (4) immobile against the stepped interior (30) of the shell (3).

7 Claims, 4 Drawing Sheets

SWITCHING ELECTRICAL CONNECTOR

FIELD OF THE INVENTION

The invention pertains to an electrical connector with an internal switch, and particularly, an internal switch that is actuated by connection with another electrical connector.

BACKGROUND OF THE INVENTION

A known electrical connector with an internal switch is disclosed in U.S. Pat. No. 5,073,123, and comprises, a conductive exterior shell concentrically encircling an insulator, and a pair of switch contacts encircled by the insulator, the switch contacts engaging one another, and one of the switch contacts being deflected by a plug contact of another electrical connector to open the switch.

SUMMARY OF THE INVENTION

According to the invention an electrical connector comprises, an internal switch constructed with a pair of conductive switch contacts retained within an insulator. The insulator is encircled by a conductive shell having a stepped interior. The contacts retain the insulator immobile against the stepped interior.

Electrical terminals on the contacts project from the insulator and from the shell for connection to a circuit board. The insulator resists movement of the contacts during connection of the terminals to a circuit board, and during deflection of one of the switch contacts by a plug contact of another electrical connector.

DESCRIPTION OF THE DRAWINGS

The invention will now be described by way of example with reference to the drawings, according to which.

DETAILED DESCRIPTION

Figure 1:
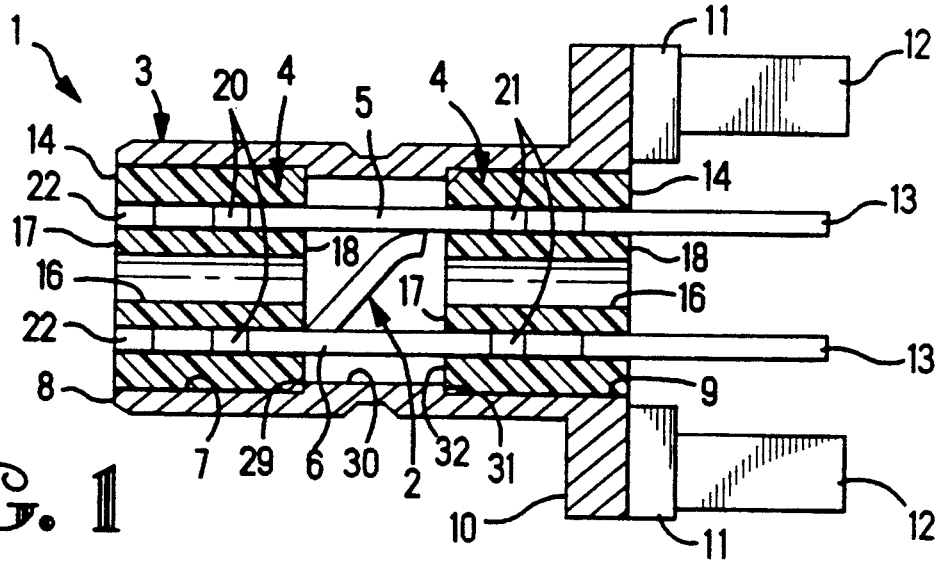
FIG. 1 is an elevation view in section of an electrical connector with an internal switch.
Figure 2:
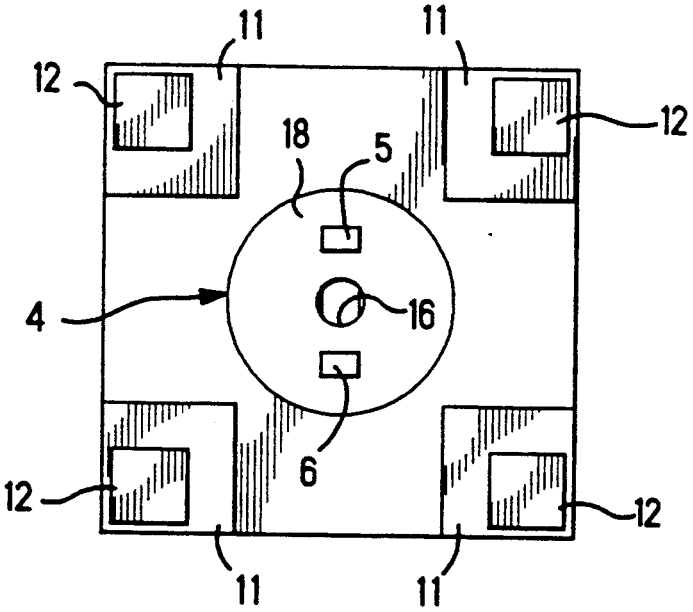
FIG. 2 is an end view of the connector shown in FIG. 1.

With reference to FIG. 1, an electrical connector 1 having an internal switch 2 comprises, a conductive exterior shell 3, a two piece insulator 4, and a pair of conductive switch contacts 5, 6. The shell 3 comprises, a hollow cylindrical portion 7, having an open front end 8 and an open rear end 9. The shell 3 projects from a broadened base 10, FIG. 2. Projecting in an opposite direction are mounting feet 11 for mounting against a circuit board, not shown. Extended posts 12 project from the mounting feet 11 for insertion into apertures of the circuit board, not shown. The portion 7 and the base 10 are of unitary construction, fabricated, for example, by die casting. The mounting feet 11 and posts 12 also are fabricated unitary with the base 10. Electrical terminals 13 of the contacts 5, 6, FIG. 1, project from the insulator 4 and from the base 10 of the shell 3 for connection to the circuit board, not shown, for example, by insertion into apertures of the circuit board.

Figure 5:
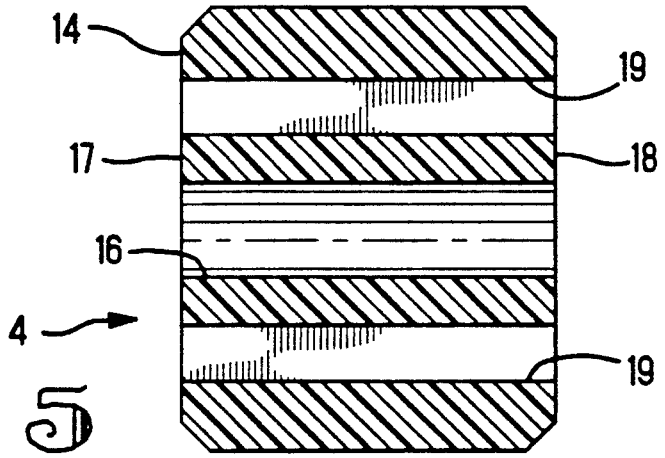
FIG. 5 is an elevation view in section of one portion of an insulator of the connector shown in FIG. 1.
Figure 6:
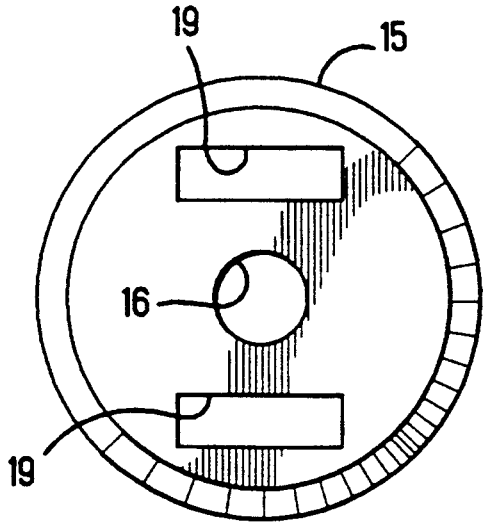
FIG. 6 is an end view of the insulator shown in FIG. 5.

With reference to FIGS. 1, 5 and 6, the insulator 4 is comprised of two identical portions 14, one of which will now be described. Each portion 14 of the insulator 4 is fabricated by molding with a cylindrical shape 15 fitting against the internal diameter of the cylindrical portion 7 of the shell 3. A coaxial passage 16 of cylindrical shape extends through the portion 14 from one end 17 to another identical end 18. The passage 16 is between a pair of spaced apart, contact receiving cavities 19 rectangular in cross section, extending parallel to the passage 16 from one end 17 to the other end 18.

Figure 4:
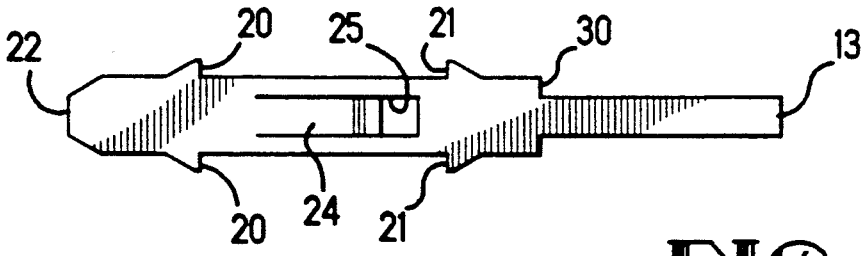
FIG. 4 is a top plan view of the contact shown in FIG. 3.

With reference to FIG. 4, the contact 6 will now be described. The contact 6 is shaped at its exterior edges as shown in FIG. 4, for example, by stamping and forming a flat strip of metal. The exterior shape includes the unitary terminal 13 and two spaced apart sets of projecting barbs 20 and 21 that are wedge shaped. The wedge shape tapers toward the nearest of the ends 22 and 23 of the contact 6. The contact 5 is identically shaped at its exterior edges.

Figure 3:
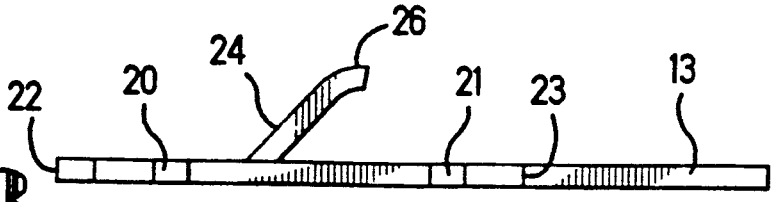
FIG. 3 is an elevation view of a switch contact of the connector shown in FIG. 1.

Only the contact 6 is formed with a cantilever beam portion 24 within the outer edges, FIG. 4. The portion 24 is outlined on three of its four sides by a slit 25 through the thickness of the contact 6. The portion 24 is then bent to project out of the plane of thickness, FIG. 3, and to have a curved free end 26 that engages the other contact 5.

With reference to FIG. 1, assembly of the connector 1 will now be described. Front ends 22 of the contacts 5, 6 are assembled into the cavities 19 of a first insulator portion 14, with the terminals 13 projecting outwardly. The first set of barbs 20 on each of the contacts 5, 6 secures the first insulator 14 onto each of the contacts 5, 6. Then the contacts 5, 6 are assembled into the front end 8 of the shell 3, the terminals 13 being inserted first into the shell 3. The first insulator portion 14 is inserted into the front end 8 of the shell 3, and will engage an internal shoulder 29 of the shell 3 facing toward the front end 8 to limit movement of the insulator portion 14 inwardly of the shell 3. The shoulder 29 is provided by a stepped interior 30 of the shell 3. The terminals 13 will project out the rear end 9 of the shell 3. The second insulator portion 14 is then assembled over the terminals 13, with the terminals 13 being received in the cavities 19. The second insulator portion 14 is moved over the terminals 13, and then moved over the contacts 5, 6, until engaging a rear facing shoulder 31 of the shell 3 to limit movement of the second insulator portion 14 inwardly of the shell 3. The second set of barbs 21 on each of the contacts 5, 6 secures the second insulator portion 14 onto each of the contacts 5, 6.

Each of the electrical contacts 5, 6 is retained within the insulator portions 14 by the barbs 20, 21. The contacts 5, 6 retain the insulator portions 14 immobile against the stepped interior 30 of the shell 3. The second insulator portion 14 resists movement of the terminals 13 in a direction inwardly of the shell 3, especially during connection of the terminals 13 to a circuit board, not shown. The internal shoulders 29, 31 are spaced apart and define an air gap 32 between the two portions 14 of the insulator 4. The portion 24 of the contact 16 projects along the air gap 32 to engage the other contact 15, and provides a normally closed switch 2.

Figure 7:
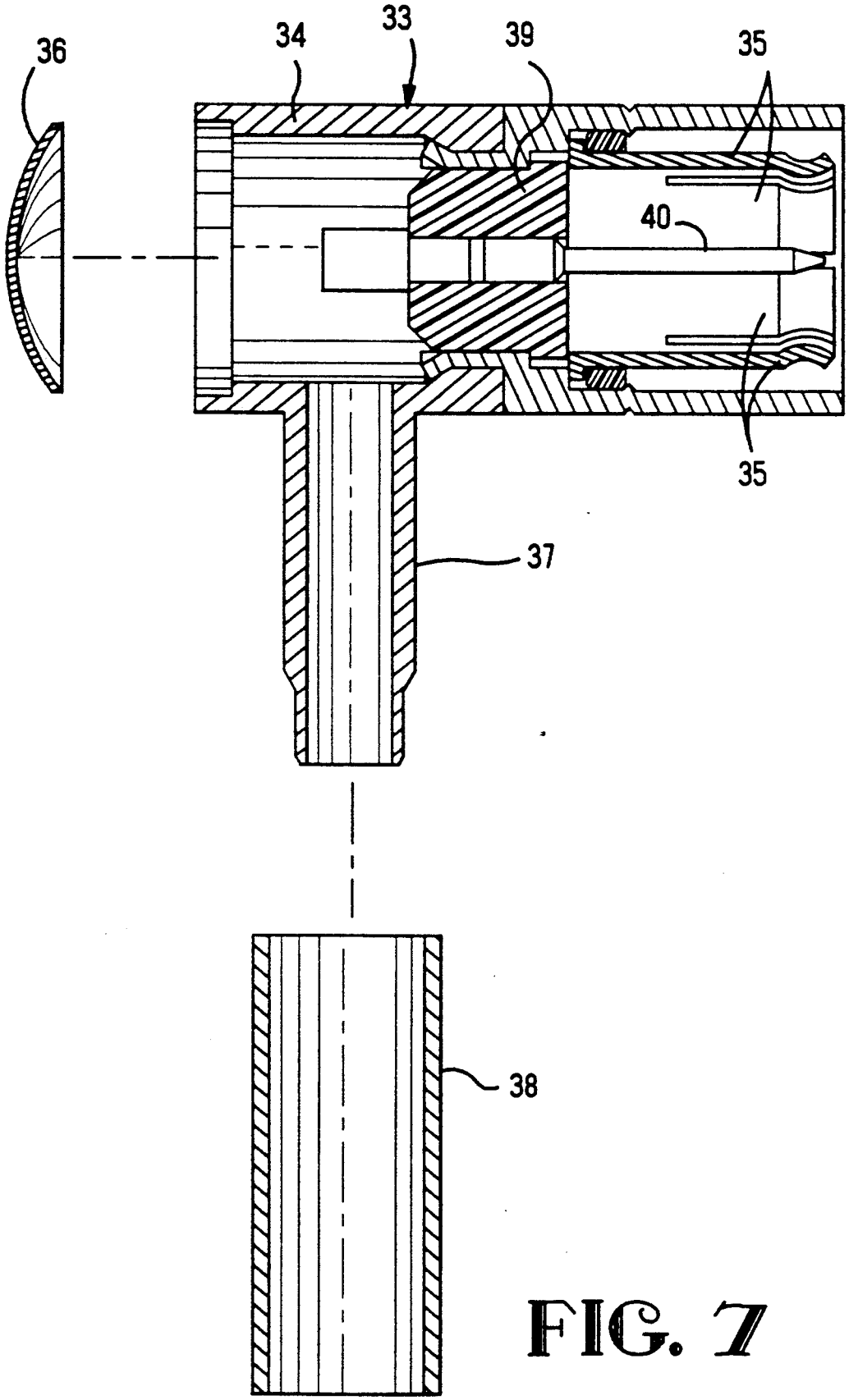
FIG. 7 is an elevation view in section with parts shown separated from one another of an electrical plug connector.
Figure 8:
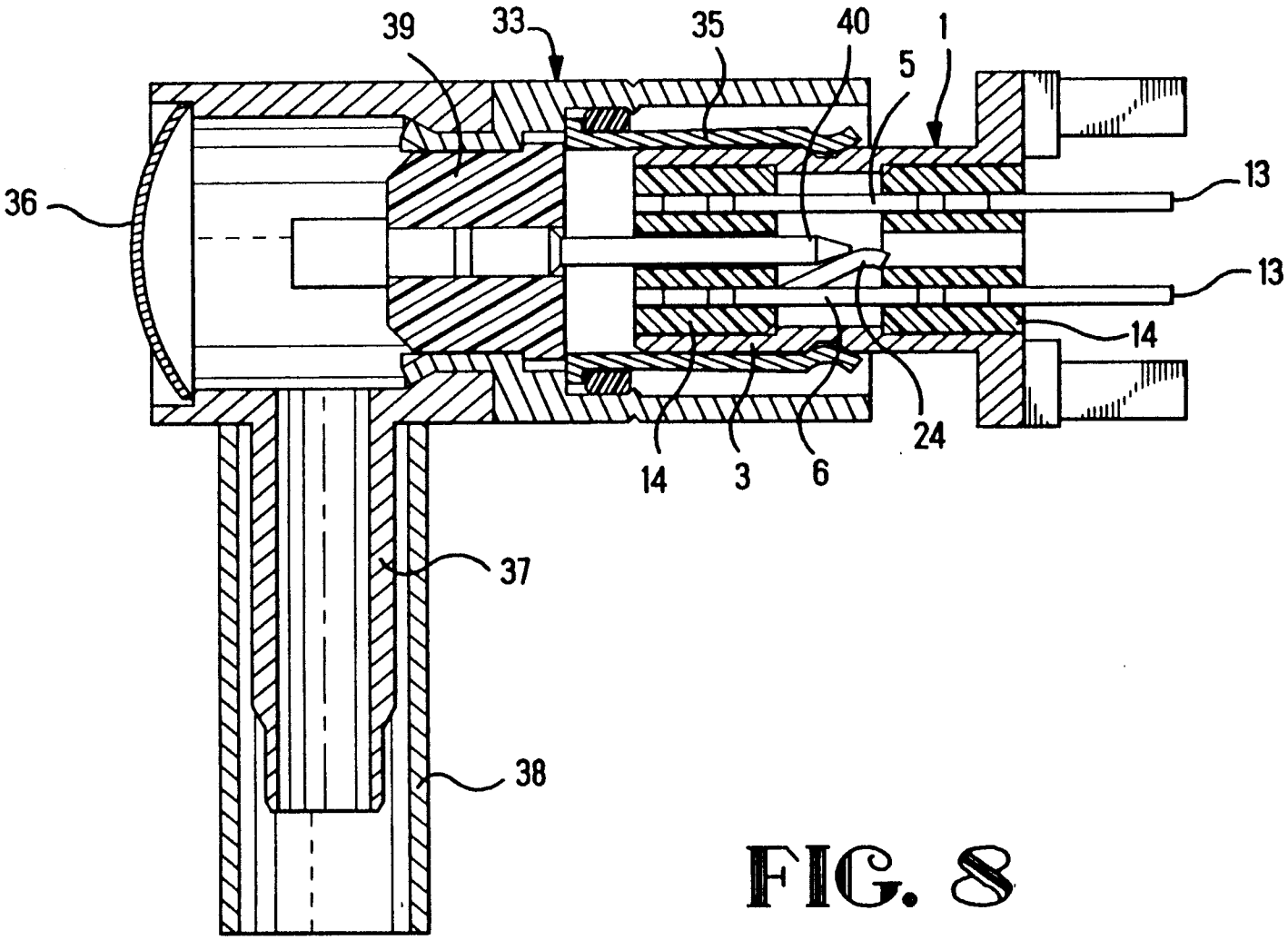
FIG. 8 is a view similar to FIGS. 1 and 7 illustrating mated connection of the connectors shown in FIGS. 1 and 7.

With reference to FIGS. 7 and 8, an electrical connector plug 33 will be described. The plug 33 comprises, a conductive outer shell 34 with resilient spring fingers 35 arranged in a cylinder shape for concentric connection to the shell 3 of the connector 1. The shell 34 has a cap 36 and a sleeve 37 for connection to a conductive sheath of a coaxial electrical cable, not shown. A crimp ferrule 38 is concentrically assembled over the sleeve 37 to clamp the sheath of a coaxial cable. The plug 33 includes an insulator 39 within the shell 34, and a conductive plug contact 40 concentrically within the insulator 39 for connection to a center conductor of a coaxial cable, not shown. The plug contact 40 is inserted along the passage 16 of the connector 1 when the connector 33 is connected to the connector 1. The portion 24 of the contact 6 is constructed as a resilient spring to be resiliently deflectable by the plug contact 40 received along the passage 16. The plug contact 40 bends solely the portion 24 out of engagement with the contact 5, thereby opening the switch 2, and electrically connecting the plug contact 40 with the contact 6 having the portion 24.

An electrical connector 1 comprises, internal switch contacts 5, 6 held by an insulator 4, wherein the insulator 4 resists movement of the contacts 5, 6 during connection of the terminals 13 to a circuit board, and during deflection of one of the switch contacts 6 by a plug contact 39 of another electrical connector 33. The contacts 5, 6 retain the insulator 4 immobile against a stepped interior 30 of the shell 3.

I claim:

1. An electrical connector having an internal switch, comprising: a conductive exterior shell with a stepped interior, an insulator divided into two identical portions and encircled by the shell, and a pair of electrical contacts retained within the insulator, a plug contact receiving passage encircled by the insulator, and a portion of one of the contacts extending to engage the other of the contacts, the portion being constructed to be resiliently deflectable upon a plug contact received along the passage an bending solely the portion out of engagement with said other of the contacts, and the contacts retaining the insulator immobile against the stepped interior of the shell.

2. An electrical connector as recited in claim 1, comprising: both portions of the insulator being received in opposite open ends of the shell and engaging spaced apart internal shoulders of the shell to limit movement of the two portions of the insulator inwardly of the shell.

3. An electrical connector as recited in claim 1, comprising: the internal shoulders being spaced apart and defining an air gap between the two portions of the insulator, and the portion of one of the contacts projecting along the air gap to engage the other of the contacts.

4. An electrical connector as recited in claim 1, comprising: the contacts being locked to the two portions of the insulator.

5. An electrical connector as recited in claim 4, comprising: the contacts having two retention barbs retaining the two portions of the insulator immobile with respect to the contacts.

6. An electrical connector as recited in claim 4, comprising: electrical terminals on the contacts extending outwardly of one of the two portions of the insulator, and extending outwardly of one open end of the shell for connection to a circuit board.

7. An electrical connector as recited in claim 6, comprising: the terminals project from one of the portions of the insulator, and one of the internal shoulders resisting movement of said corresponding one of the portions of the insulator in a direction inwardly of the shell, and said corresponding one of the portions of the insulator resisting movement of the terminals in a direction inwardly of the shell.

* * * * *